US007914213B2

(12) United States Patent
Scarton

(10) Patent No.: US 7,914,213 B2
(45) Date of Patent: Mar. 29, 2011

(54) DEVICE FOR PRINTING RECEIPTS USING TWO PRINTING UNITS, PARTICULARLY ON THERMAL PAPER, AND RELATED PRINTING METHOD

(75) Inventor: Gianrico Scarton, Ivrea (IT)

(73) Assignee: Telecom Italia S.p.A., Milan (IT)

( * ) Notice: Subject to any disclaimer, the term of this patent is extended or adjusted under 35 U.S.C. 154(b) by 698 days.

(21) Appl. No.: 10/579,853

(22) PCT Filed: Nov. 16, 2004

(86) PCT No.: PCT/IT2004/000632

§ 371 (c)(1),
(2), (4) Date: Mar. 16, 2007

(87) PCT Pub. No.: WO2005/047006

PCT Pub. Date: May 26, 2005

(65) Prior Publication Data

US 2007/0172294 A1 Jul. 26, 2007

(30) Foreign Application Priority Data

Nov. 17, 2003 (IT) ..... TO2003A0909

(51) Int. Cl.
*B41J 3/60* (2006.01)
*B41J 29/38* (2006.01)
*B41J 11/70* (2006.01)

(52) U.S. Cl. ..... 400/76; 400/149; 400/621; 347/104

(58) Field of Classification Search ..... 400/149
See application file for complete search history.

(56) References Cited

U.S. PATENT DOCUMENTS

| | | | | |
|---|---|---|---|---|
| 5,748,204 | A * | 5/1998 | Harrison | 347/2 |
| 6,151,037 | A * | 11/2000 | Kaufman et al. | 347/2 |
| 6,543,946 | B2 * | 4/2003 | Hori et al. | 400/487 |
| RE38,473 | E * | 3/2004 | Smolenski | 400/120.16 |
| 6,789,969 | B2 * | 9/2004 | Hirabayashi et al. | 400/693 |
| 7,170,538 | B2 * | 1/2007 | Klein | 347/171 |
| 2003/0086740 | A1 | 5/2003 | Miyajima | |
| 2003/0156877 | A1 * | 8/2003 | Tischer | 400/247 |

FOREIGN PATENT DOCUMENTS

EP 0 834 828 A 4/1998

(Continued)

*Primary Examiner* — Daniel J Colilla
(74) *Attorney, Agent, or Firm* — Venable LLP; Robert Kinberg; Steven J. Schwarz

(57) ABSTRACT

A printing device (11) for printing receipts (12), each bearing constant data (41*a*) that render the receipt (12) identifiable, and variable data (41*b*), indicating the operations to be documented on the receipt in question, comprising: a roll (16) of thermal paper suitable for feeding a continuous ribbon (16*a*) of thermal paper a first ink jet printhead (22), and a second thermal printhead (23), in which the first ink jet printhead (22) is provided for printing on the thermal paper ribbon (16*a*) the constant data (41*a*) due to figure on a new receipt (12), independently from and prior to the relative variable data (41*b*) becoming available, and in which the second thermal printhead (23) is provided for subsequently printing the variable data (41*b*), once available, so as to complete printing of the new receipt (12). The printing device is particularly useful, making the printing and issue of a receipt faster, after the relative variable data have been input, thereby reducing waiting time for the user that the receipt is to be issued for.

11 Claims, 4 Drawing Sheets

FOREIGN PATENT DOCUMENTS

| | | | | |
|---|---|---|---|---|
| EP | 0 928 698 | A | | 7/1999 |
| EP | 1 142 713 | A2 | | 10/2001 |
| EP | 1 198 117 | A | | 4/2002 |
| GB | 2 072 102 | A | | 9/1981 |
| IT | TO2002A000428 | | | 5/2002 |
| JP | 09226184 | A | * | 9/1997 |
| JP | 2003251595 | A | * | 9/2003 |
| WO | WO-03/097362 | A2 | | 11/2003 |

* cited by examiner

DEVICE FOR PRINTING RECEIPTS USING TWO PRINTING UNITS, PARTICULARLY ON THERMAL PAPER, AND RELATED PRINTING METHOD

FIELD OF THE INVENTION

This invention relates in general to a printing device, and more precisely to a device for printing and releasing receipts or similar tickets or documents, such as in particular the receipts that are issued at the cash desks located in the usual points of sale, such as shops, stores, supermarkets, etc., or in restaurants, bars, or in other types and categories of commercial concerns.

BACKGROUND OF THE INVENTION AND STATE OF THE ART

A common receipt, issued by a printer installed at the cash desk of a commercial concern, is normally obtained from a continuous ribbon, or from a strip coming from a roll housed inside the printer, and generally bears a graphic representation in a first area, which is repeated identically on each receipt, such as a symbol or a logo or a wording indicative of and suitable for identifying the concern issuing the receipt, and a range of data in a second area, data that can obviously vary from receipt to receipt and, on account of this, also called variable data, such as the list of items purchased and the relative amount, in respect of the specific operation carried out by the user in the concern associated with the cash desk.

It is very important that the steps connected with printing and issuing a receipt are performed extremely rapidly in order to reduce waiting times of the users, and accordingly reduce the risk of queues forming at the cash desks, especially in those places, such as supermarkets, where user traffic is particularly high.

Unfortunately this requirement to print receipts as quickly as possible is often in conflict with the fact that printing of the logo or symbol identifying the commercial concern may require considerable printing times, times that are added to those for printing the variable data, especially when the logo is a complex one, is of a certain size and/or is in colour.

In these cases in fact, the complete printing of a receipt, i.e. of the constant data such as the fixed, preestablished logo identifying the commercial concern, and of the variable data indicative of the operation carried out, may involve a significant waiting time, that impacts considerably on the total waiting times of a user at the cash desk, possible result of which is the undesirable generation of queues of users at this cash desk.

Numerous are the types of printing devices currently used in commerce, provided for issuing receipts, and which work by printing data on a continuous ribbon of paper coming from a roll on which the ribbon is wound, and subsequently cutting the printed ribbon in order to form a receipt.

These devices adopt various technologies for printing the receipts, in particular the technology called thermal paper printing, for simplicity's sake also called thermal printing technology for short, and the ink jet technology, technologies which may undoubtedly be considered as the most widespread and used on the market.

In the former case, printing is performed by a dot matrix type printhead, usually not having transversal movements with respect to the paper ribbon and having a width roughly corresponding to the width of the line of print to be printed on the ribbon, in which the printhead is arranged for sliding in contact with a special or surface-treated paper, also called thermal paper. During printing, while the paper advances in front of the head, the dots of the latter are selectively heated to transmit the heat generated to the thermal paper, which accordingly blackens so as to generate the printed characters and/or symbols.

In the second case, printing is performed by a printhead, again dot-matrix type, generally provided with an alternating motion in front of the paper ribbon coming from the roll, in which the printhead comprises numerous nozzles suitable for selectively emitting, during the alternating motion, droplets of black or colour ink on the paper, usually plain type, i.e. not treated, to generate on the latter the characters and/or printed symbols.

In a variant of the thermal printing technology, much used for printing receipts and also called ink transfer thermal technology, printing can be performed on plain paper, i.e. not thermal and not treated; here a dot matrix printhead, structurally similar to the one mentioned above, is used for printing on special thermal paper, and a ribbon on which a thin layer of solid ink has been deposited is inserted between the printhead and the normal paper.

In practice, the dots of the head are heated selectively in order to heat dot-like areas of the ribbon which, in this way, in correspondence with the heated areas, causes the ink to melt and be released on the paper, so that the characters and/or printed symbols are generated on the latter.

On the subject of the two printing technologies recalled above, the thermal printing technology, including that on special thermal paper and that on plain or normal paper in the ink transfer variant, has the important advantage of being quite economical, at least for printing in black and white, and has the characteristic that it allows numerous lines to be printed on a receipt at a high printing speed, and also produces a print of very sharp and precise definition, as is required in particular in printing special symbols such as the bar codes widely used on receipts.

Conversely, the thermal printing technology is slow and sometimes not economically convenient for colour printing, in this case requiring the use of very high cost accessories, such as special papers and multicolour type thermal transfer ribbons; in addition, it requires special mechanisms and circuits for management of these accessories, and these cause the cost of the printer to soar.

On the other hand, the ink jet printing technology has the advantage of being competitive, with respect to the thermal technology, for colour printing, on account of offering a higher print speed, of being able to produce colour printing on a printer built substantially like a standard ink jet printer for black and white printing, and on account of the fact that it uses accessories, such as a specific printhead containing various coloured inks, having a structure and therefore a cost not unlike those envisaged for black and white printing.

Against this, an ink jet printhead, due to its alternating motion with respect to the paper ribbon to cover the various lines of a receipt, may imply a much greater time to print these lines than a thermal printhead, at least for black and white printing.

These known devices or printers do not, however, appear to solve in full the problem of printing a receipt in a substantially limited time, and thus satisfy all the operating requirements and market requirements, so that there is still considerable space and opportunity for further improvement.

In particular, it has been seen that the time to print the logo, whether at the top or the bottom of the receipt, significantly impacts upon the time the user has to wait at the cash desk, before receiving the fully printed receipt.

SUMMARY OF THE INVENTION

A primary object of the present invention is therefore to produce a device for printing receipts, having a first portion bearing constant, pre-stored data and a second portion bearing variable data, that is capable of overcoming the limitations and problems, particularly with regard to the still high time to print each receipt, which unfortunately afflict the printing devices currently on the market, and thus significantly sped up the operations involved in printing and delivering receipts at a cash desk, and consequently reduce the risk of undesirable queues forming.

A further object of this invention is to enable the printing in fast mode and at low cost of receipts bearing a colour logo or symbol indicative of the concern issuing the receipt, thus promoting and making economically acceptable the use of these attractive colour receipts.

The above-mentioned objects are reached by the printing device and method having the characteristics defined by the main independent claims.

BRIEF DESCRIPTION OF THE DRAWINGS

These and other characteristics, aspects and objects of the invention will come across more clearly from the following description of a preferred embodiment, provided merely as a non-restrictive example, with reference to the figures in the accompanying drawings, in which.

Detailed description of a preferred embodiment of the invention

Figure 1:
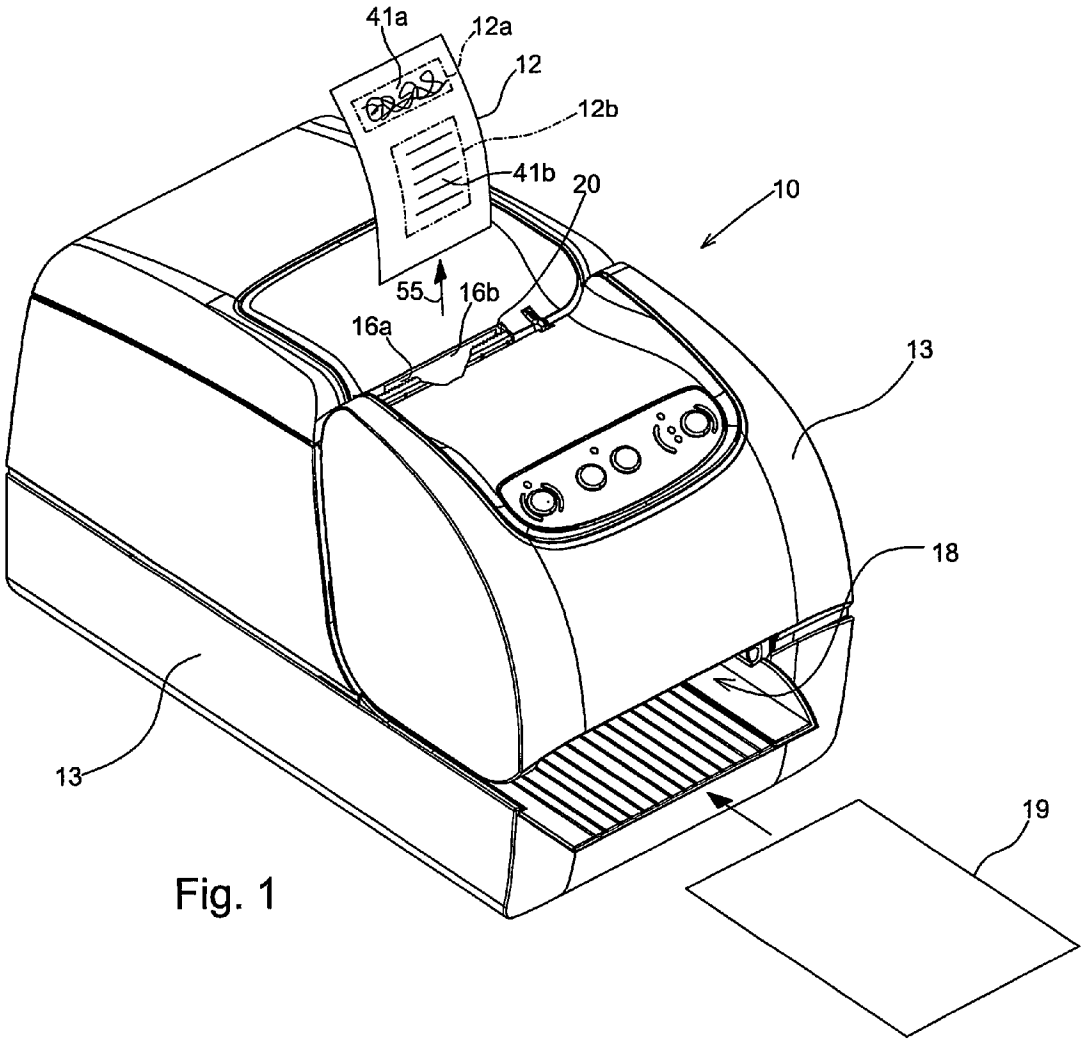
FIG. 1 is a perspective view of a printer, typically associated with the cash desk of a commercial concern, which incorporates a device for fast printing and issue of receipts built in accordance with this invention.
Figure 2:
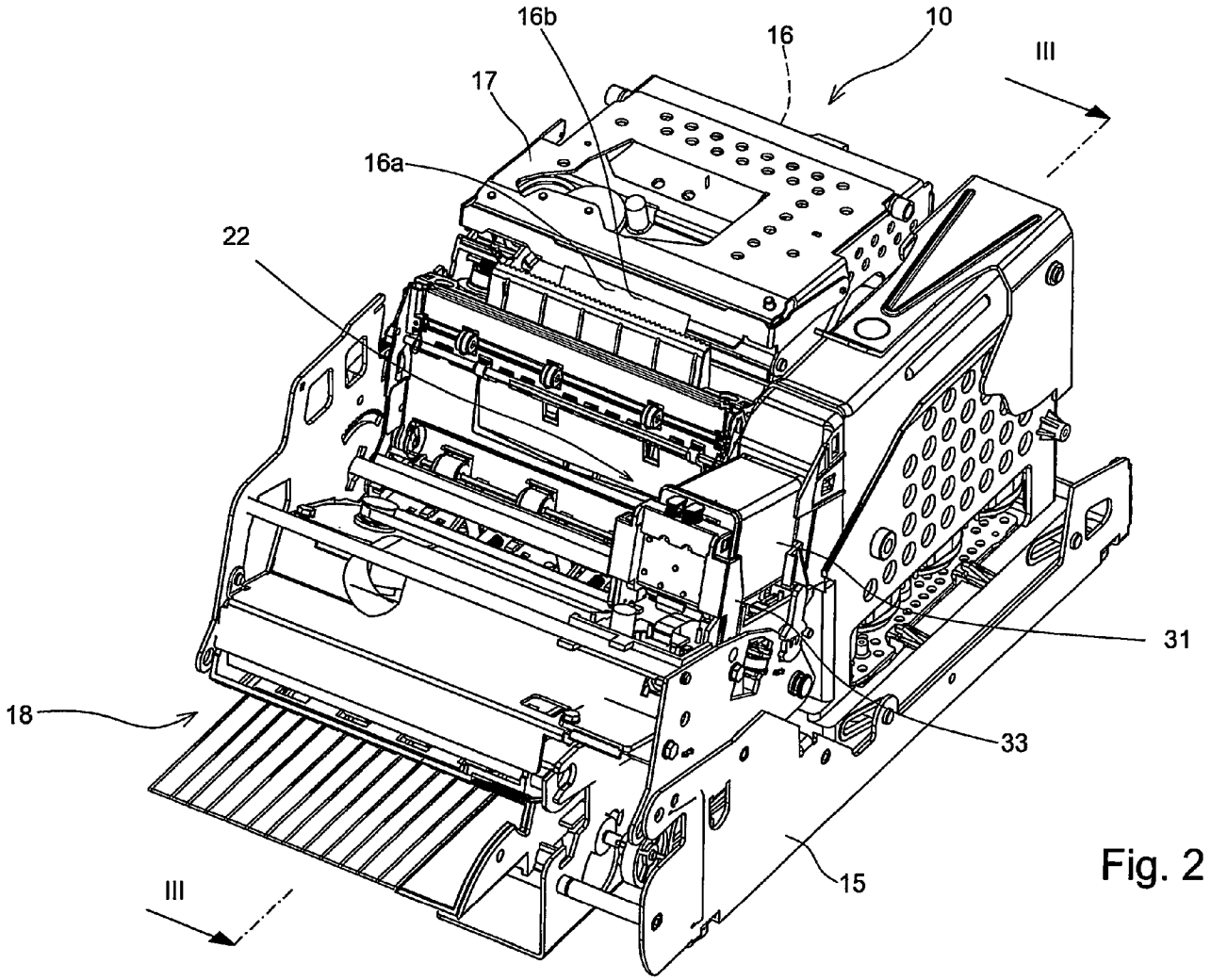
FIG. 2 represents in perspective from a different angle the printer of FIG. 1, with its outer case removed.
Figure 3:
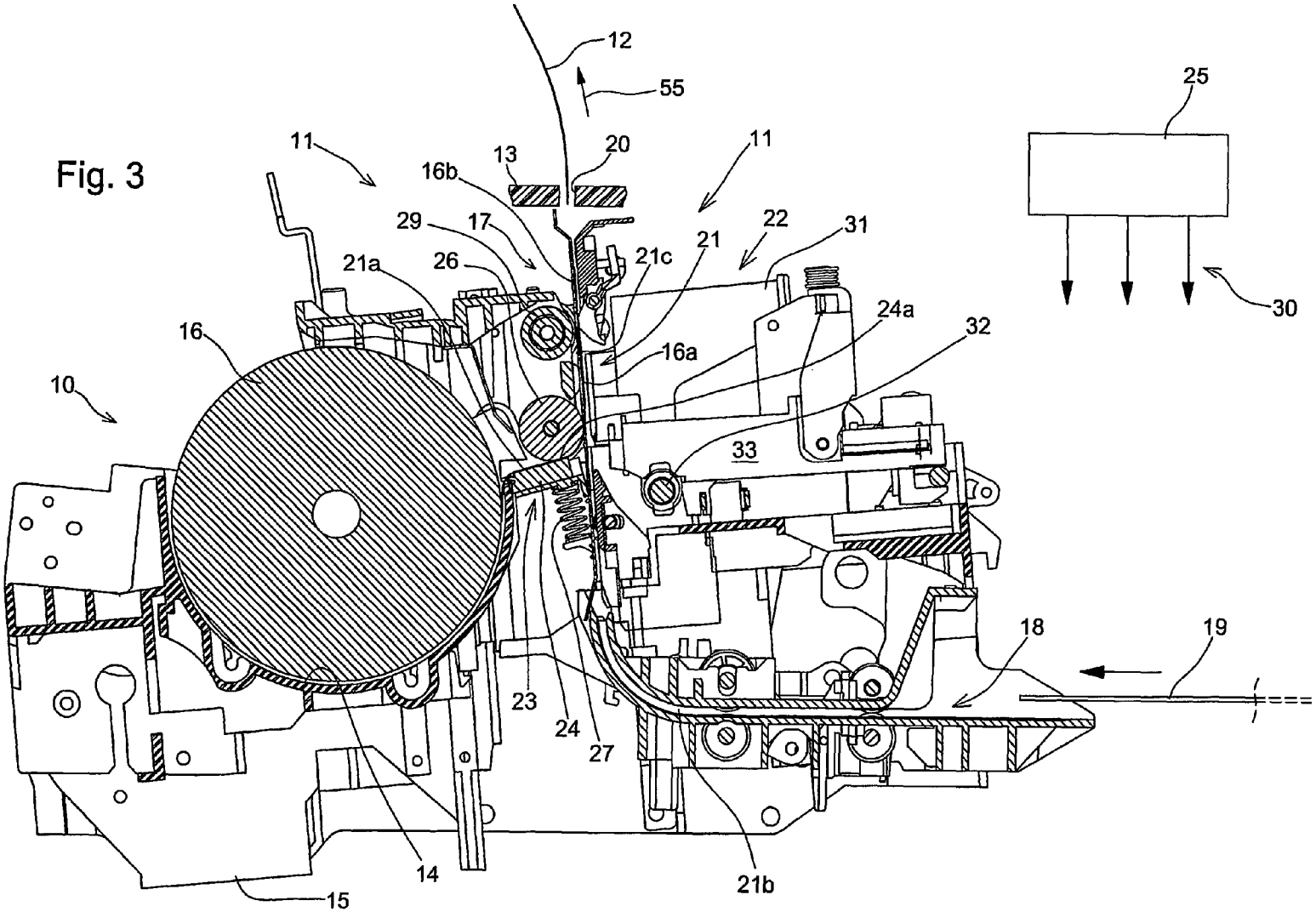
FIG. 3 is a partial longitudinal section of the printer according to the line III-III of FIG. 2.

With reference to FIGS. 1-3 a printer, integrating within a printing device 11 according to this invention, for printing and issuing receipts 12, is generically indicated with numeral 10.

The printer 10 is usually associated with the cash desk of a commercial concern or a point of sale, such as a supermarket, store, bar, restaurant, etc., and—in terms of its structure and mode of use—has many analogies and similarities with the printer described in the Italian patent application T02002A000428 filed on behalf of Tecnost Sistemi S.p.A, which application should be referred to for any other general and/or detailed information not found hereabout the printer 10.

In particular the printer 10 has an outer case 13; a support structure 15 accommodated inside the case 13 and arranged for supporting the various members of the printer 10; an internal seat 14 made in the structure 15 for housing a roll of paper 16, in turn provided for feeding a continuous ribbon of paper 16*a* intended to be printed on; a cutter unit 17, of known type, suitable for cutting the paper ribbon 16*a* after printing, in such a way as to form the receipts 12; an outlet aperture 20 made in the case 13 for delivery to the outside of the receipts 12; and an electronic control unit 25, represented schematically in FIG. 3, containing the various circuits and the program provided for controlling operation of the printer 10.

Optionally the printer 10 may include an inlet aperture 18 for the introduction of documents 19, consisting of sheets distinct from one another, such as cheques, etc. . . . , intended for processing and printing by means of the printer 10.

The electronic control unit 25 is provided for commanding the various members of the printer 10 through a plurality of lines 30, also represented schematically in FIG. 3, and in particular for sending signals commanding the printing of receipts 12 through these lines.

The roll 16 and therefore the relative continuous ribbon 16*a* are made of thermal paper, i.e. with treated paper provided with a special outer layer which possesses the ability to blacken in such a way as to form a black dot, when locally heated by a dot-like heat source, thus allowing data to be printed on the ribbon 16*a* using thermal technology, as will be better described below.

This type of thermal paper is widely known and used on the market, rendering further provision of information about its characteristics and/or composition superfluous and pointless, such information not being essential for an appreciation of the invention. What is already known on the subject may be consulted.

FIG. 3 represents in greater detail and in cross-section the printer 10 and relative printing device 11 according to the invention.

In particular, the printing device 11 comprises a print path 21 which is intended to convey to the outside the ribbon of thermal paper 16*a* fed from the roll 16, and which has a first starting stretch 21*a*, adjacent to the roll 16, and a second end stretch 21*c*, adjacent to the outlet aperture 20.

So as to also manage the documents 19, such as cheques, which are inserted through the inlet aperture 18, the printing device 11 may include a further path, specifically for the documents 19, comprising a stretch 21*b* which starts in correspondence with the aperture 18 and joins the printing path 21 of the ribbon 16, between the stretch 21*a* and the stretch 21*b*.

In this way, the documents 19 inserted through the inlet aperture 18 are conveyed along stretch 21*b* to join and then exit from to the outside the end stretch 21*c* of the path 21, since stretch 21*c* is also common to the continuous ribbon 16*a* of thermal paper and the documents 19 consisting of single separate sheets.

In addition the device 11 comprises a first printing unit 22 and a second printing unit 23, located along the print path 21 and suitable for receiving print commands from the control unit 25, in which the first printing unit 22 is arranged alongside and adjacent to the end stretch 21*c*, and the second printing unit 23 is arranged alongside the starting stretch 21*a*.

In detail the first printing unit 22 comprises an ink-jet printhead 31, therefore having a plurality of nozzles for emitting droplets of ink on the ribbon 16*a*, which may be of the type containing black ink for black and white printing, or various colour inks for colour printing on the ribbon 16*a*.

The ink jet printhead 31 is removably mounted on a carriage 33 which, in turn, is suitable for sliding on a guide-way 32 and is also adapted for being moved by an appropriate mechanism, not shown in the drawings, so as to shift the printhead 31 backwards and forward in front of the ribbon 16*a*, during the phase in which a line is printed on the ribbon 16*a*.

In turn, the second printing unit 23 comprises a printhead 24 of a type suitable for printing on thermal paper, and for this reason also called thermal printhead, and a feeding roller 26 provided for rotating adjacent to the printhead 24.

Unlike the ink jet printhead 31, transversally mobile with respect to the ribbon 16*a* during printing of a line, the thermal printhead 24 is arranged in a fixed position, in a direction that is transversal with respect to the ribbon 16*a*, and is of the in-line type, i.e. having a width substantially corresponding to that of the line to be printed on the ribbon 16*a*.

This thermal printhead 24 rests against the feeding roller 26 urged by a spring 27, with the ribbon 16*a* in between, so that when the feeding roller 26 rotates the ribbon 16*e* is made unwind from the roller 16*a* and consequently to advance, with respect to the thermal head 24, along the stretch 21*a* and then also along the end stretch 21*c* of the feeding path 21.

Further feeding and guiding means, for instance including a roller 29, may be provided for cooperating with the rotating roller 26 in order to feed and guide the paper ribbon 16*a* along the path 21, and thus convey it to the outside of the printer 10 through the aperture 20.

In greater detail, the printhead 24 consists of a silicon substrate that bears a line of resistors 24*a* which extend in a direction transversal to the ribbon of thermal paper 16*a*, in correspondence with the area where the printhead 24 rests against the feeding roller 26, and which are therefore only visible as a dotted lines in FIG. 3.

These resistors can be energized electrically in response to print commands received from the control unit 25, to selectively heat dot-like areas of the ribbon 16*a* so as to form symbols and printed characters on the latter.

The thermal head 24 and the feeding roller 26 are arranged in such a way as to cause the ribbon of thermal paper 16*a* to make a kind of step along the feeding path corresponding to the first stretch 21*a*, before coming to the outlet stretch 21*c*.

As both the thermal paper printing technology and the ink jet printing technology are widely known and applied, and as neither of them have, at least in the context of the present invention, special characteristics and/or application arrangements that could differentiate them with respect to current usage, these two technologies will not described any further, all other details being obtainable from the information available on the subject.

Figure 4:
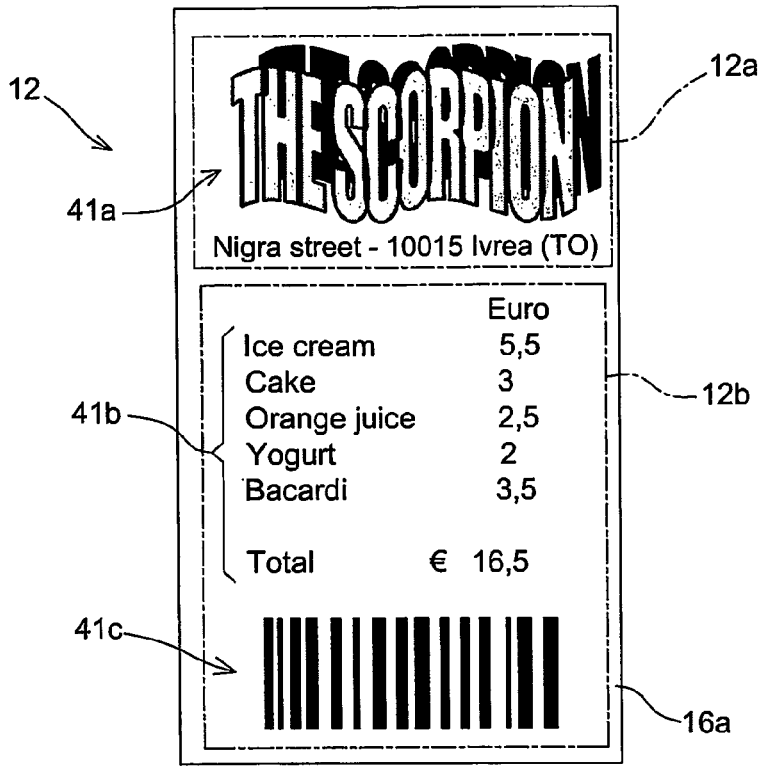
FIG. 4 shows a typical receipt issued by the printer of FIG. 1.

FIG. 4 is a schematic illustration of the configuration of a typical receipt 12 produced by the printer 10.

In particular, as already anticipated, the receipt 12 is obtained by cutting, after the printing, a given stretch of the ribbon 16° of thermal paper, and has a first portion or area 12*a*, bounded by the dot-and-dash line, which bears a first series of data and/or information 41*a* which usually corresponds to a wording and/or a name and/or a logo and/or a graphic symbol and which unmistakeably identifies the entity issuing the receipt, and also has a second portion or area 12*b*, again bounded by a dot-and-dash line, which contains a second set of data and/or information 41*b*, often printed on various lines, which corresponds to the various operations that are carried out by the user and which have to be documented with the receipt 12.

For simplicity's sake the data 41*a* borne on the portion 12° will be called constant or fixed data for short, in that it is unchanging from one receipt to the next, in the context of the receipts issued by the same commercial concern or generally speaking issuing entity, and for the purpose is in general pre-stored in the control unit 25; the data 41*b* borne on the portion 41*b* will be called variable data for short, in that it is usually subject to change from one receipt to the next, depending, as explained above, on the specific operations carried out by the user.

The variable data figuring on the receipt 12 may also include information of the bar code type, indicated with numeral 41*c*, according to arrangements for configuring the receipts that are widely known and used.

DESCRIPTION OF OPERATION OF THE DEVICE ACCORDING TO THE INVENTION FOR FAST PRINTING OF RECEIPTS

Figure 5:
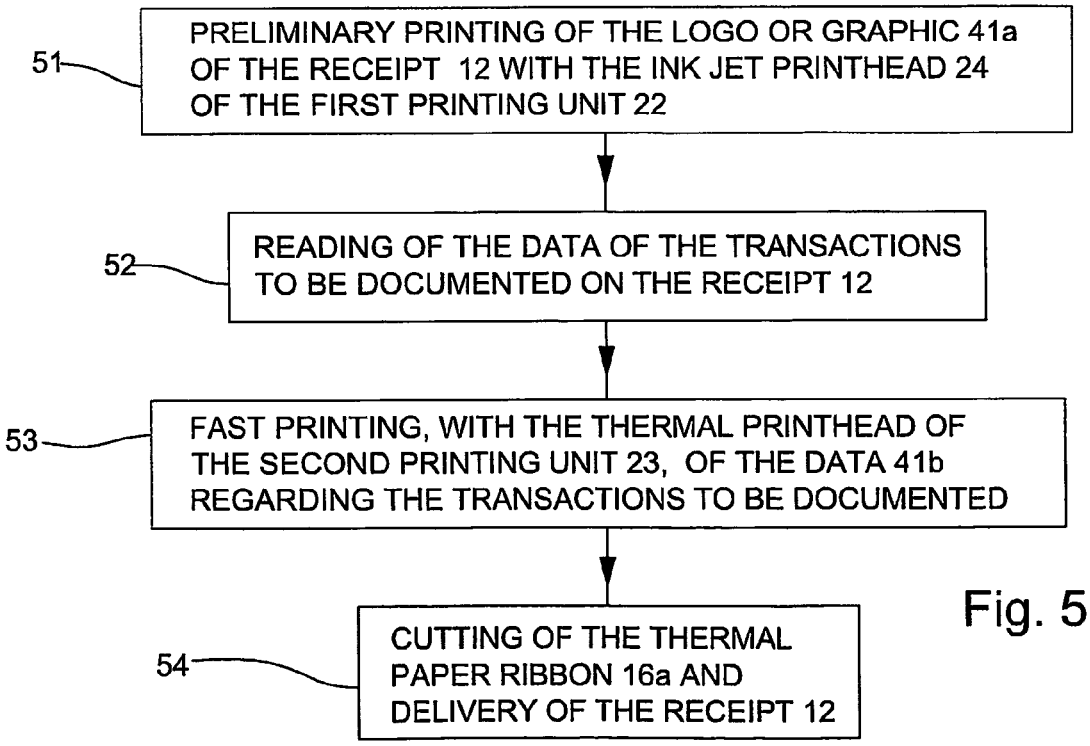
FIG. 5 is a flow chart explaining operation of the device of FIG. 1 for fast printing and issue of receipts.

Operation of the device 11 for fast printing and issue of receipts will now be described in detail, with reference to FIG. 4 which illustrates the configuration of a receipt 12 and the flow chart of FIG. 5.

To begin with, immediately after a generic receipt has been cut and issued, the ribbon 16*a* stands with an end edge 16*b* positioned roughly in the vicinity of the outlet aperture 20 of the printer 10, as depicted in FIG. 1. In particular, the edge 16*b* corresponds to the cut just made by the cutter unit 17 to determine detachment and issue of the generic receipt by the printer 10.

At this point, during a preliminary step 51, before receiving and having available the variable data to be documented on the next receipt, the control unit 25 commands, via the ink jet printhead 31 of the first printing unit 22, printing on the ribbon 16 of the portion 12*a* with the relative constant data 41*a*, such as the logo and/or the symbols already stored in the control unit 25, which identifies the entity issuing the receipts.

In other words, immediately after a generic receipt has been issued, the control unit 25 straight away, through the first ink jet printing unit 22, has the constant data 41*a* destined to appear on a next, new receipt printed on the ribbon 16*a*.

It is clear therefore that in this preliminary step 51, the variable data 41*b*, defined by the operations carried out by the user and intended to be documented with the next receipt, is not actually available for the control unit 25, nor is it able to condition corresponding print commands for the device 11.

Consistently with the possible, though not exclusive, disposition shown in FIG. 3, of the printing units 22 and 23 along the print path 21, the constant data 41*a* and accordingly the corresponding portion 12*a* are printed on an area of the ribbon 16*a* adjacent to and immediately under the edge 16*b*.

Usually, during this preliminary step 51, the ribbon 16*a* advances longitudinally, according to a line feed motion, to enable complete printing of the constant data 41*a* with the ink jet head 31.

At the end of the preliminary step 51, that is upon completion of printing of the constant data 41*a*, the control unit 25 goes into a wait state, so as to be ready to receive the variable data to be documented on the next receipt, while the ribbon 16*a* finishes advancing and goes into position, with the blank area underneath the portion 12*a*, in correspondence with the thermal head 24 of the second printing unit 23.

When this variable data 41*b* has effectively become available, for instance after if has been keyed in on a keyboard or has been read (step 52) by a reading device of the system associated with the printer 10, then the control unit 25 commands, particularly in response to an appropriate print command, printing (step 53) of this variable data 41*b* on the ribbon 16*a* in correspondence with the portion 12*b* through the thermal printhead 24 of the second printing unit 23.

At this point, printing of the data on the ribbon 16*a* of thermal paper is complete, so that the control unit 25 commands in a known way, during a step 54, a further feeding of the ribbon 16*a* and activation of the cutter unit 17, so as to produce the detachment, that is the issuing, of the receipt 12 by the printer 10, as symbolically represented by the arrow 55 of FIG. 1.

This cycle is repeated substantially identically for each subsequent receipt.

It emerges clearly from the above that the operation of the printing device 11 of the invention is such as to significantly reduce the time a user has to wait before receiving a receipt, once the variable data that has to be documented on such a receipt has been entered, thereby significantly diminishing the risk of undesirable queues of users forming in front of the cash desks that use this new printing device.

In fact, the printing of the fixed logo, which corresponds to a significant portion of the total time required for printing all the data of a receipt, is suitably carried out in advance during a preliminary step, that is to say in a step in which the other data—corresponding to the operations carried out by the user and to be documented on the receipt—is still not available, so that when this other data does become available, it is possible to obtain a complete printing of the receipt with all the data and thus issue the receipt in a relatively short and fast time, and thereby achieve a reduced wait time for the user.

Furthermore, in this mode, preliminary printing of the logo may be carried out concurrently with other operations, which are necessary and implicit in the management of a cash desk.

For example, with reference to the typical case represented by a cash desk in a supermarket, the logo of each receipt can be printed during the time it takes to remove from the counter of the cash desk all the items that have been recorded on the previous receipt just issued, and to load new items onto the counter, i.e. without affecting and/or extending the overall time for management of the cash desk operations.

FURTHER EMBODIMENTS

Without departing from the scope of the invention the second printing unit may still be thermal type, but in the so-called thermal transfer variant, in such a way as to produce the print on a ribbon of common or normal paper, i.e. without using the special thermal paper which is sensitive to heat.

In this case, the second printhead 23 has a structure substantially similar to that described earlier, for printing on thermal paper, and is associated with an ink ribbon that is placed between the printing medium which, as already said, is plain paper, and the thermal printhead itself.

During use, the ink ribbon is heated selectively in dot-like areas of the printhead, so as to transfer the ink on to the plain paper and in this way produce the printing.

Again, instead of along the starting stretch 21*a* of the print path 21, the second thermal printing unit 23 may be arranged along the relative end stretch 21*c*, common to both the ribbon 16*a* and the documents 19 entered through the aperture 18, thus allowing printing, on these documents 19 as well, of information by means of the printing units 22 and 23 based respectively on the two ink jet and thermal technologies.

It remains understood that changes may be made to the shape and dimensions of the various components of the receipt printing device, described up to here, as well as improvements, additions and/or replacements of parts, without departing from the scope of this invention.

The invention claimed is:

1. Printing device for receipts, each receipt having a first area bearing constant data that is the same from one receipt to another, and a second area bearing variable data that varies from one receipt to another, said device comprising:

a roll containing a continuous paper ribbon, a first printing unit, ink jet, dot-matrix type, a second printing unit thermal, dot-matrix type, said first and said second printing units being arranged along a print path, a feeding mechanism that feeds said paper ribbon along said print path to permit printing of said paper ribbon by said first and said second printing units, a cutter that cuts said continuous paper ribbon after the printing, so as to form the receipts, and a control unit connected to said first ink jet printing unit and said second thermal printing unit, the control unit adapted to cause, for each receipt, said first ink jet printing unit to print on said paper ribbon said constant data, and to cause said second thermal printing unit to print on said paper ribbon said variable data wherein:

said control unit is adapted to manage the operation of said printing device so that said first ink jet printing unit prints said constant data for each of said receipts, automatically and independently of said variable data, during a first preliminary printing step, and said second thermal printing unit prints, in response to a print command, said variable data received from said control unit and relative to each of said receipts, during a second printing step following said first printing step, said second thermal printhead is adapted to print, during said second step subsequent to said first step, a given length of said ribbon at a printing speed that is greater than that of said first ink jet printhead, during said first step, said first ink jet printing unit is colour type for printing on said paper ribbon, in colour form, predetermined symbols and/or characters, said second thermal printing unit is of the in-line type and comprises a printhead arranged in a fixed position transversally with respect to said paper ribbon and also having a width substantially corresponding to that of a single line to be printed on said paper ribbon, and said first ink jet printing unit is arranged downstream of said second thermal printing unit along said print path according to the direction of feeding of said paper ribbon.

2. Printing device for receipts, each receipt having a first area bearing constant data that is the same from one receipt to another, and a second area bearing variable data that varies from one receipt to another, said device comprising:

a roll containing a continuous paper ribbon, a first printing unit, ink jet, dot-matrix type, a second printing unit thermal, dot-matrix type, said first and said second printing units being arranged along a print path, a feeding mechanism that feeds said paper ribbon along said print path to permit printing of said paper ribbon by said first and said second printing units, a cutter that cuts said continuous paper ribbon after the printing, so as to form the receipts, and a control unit connected to said first ink jet printing unit and said second thermal printing unit, the control unit adapted to cause, for each receipt, said first ink jet printing unit to print on said paper ribbon said constant data, and to cause said second thermal printing unit to print on said paper ribbon said variable data, wherein said control unit is adapted to manage the operation of said printing device so that said first ink jet printing unit prints said constant data for each of said receipts, automatically and independently of said variable data, during a first preliminary printing step, and said second thermal printing unit prints, in response to a print command, said variable data received from said control unit and relative to each of said receipts, during a second printing step following said first printing step, wherein said second thermal printhead is adapted to print, during said second step subsequent to said first step, a given length of said ribbon at a printing speed that is greater than that of said first ink jet printhead, during said first printing step, wherein said second thermal printing unit is of the in-line type and comprises a printhead arranged in a fixed position transversally with respect to said paper ribbon and also having a width substantially corresponding to that of a single line to be printed on said paper ribbon, wherein said first ink jet printing unit is arranged downstream of said second thermal printing unit along said print path according to the direction of feeding of said paper ribbon.

3. Printing device according to claim 2, wherein said continuous paper ribbon comprises heat-sensitive thermal paper and said second printing unit is adapted to print on said thermal paper by selectively heating dot-like areas of said thermal paper.

4. Printing device according to claim 2, wherein said continuous paper ribbon comprises plain paper, and said second printing unit is adapted to print on said plain paper by selectively heating dot-like areas of a printhead so as to transfer ink to said plain paper.

5. Printing device according to claim 2, wherein said first ink jet printing unit is adapted to print said constant data on said paper ribbon, in response to a print signal generated after the cutting of a receipt.

6. Printing device according to claim 2, further comprising a further print path for single documents consisting of single separate sheets, wherein said further print path extends between an entrance zone that receives said single documents, and an exit zone that delivers said single documents to the outside after printing, wherein said further print path shares a common outlet stretch with the print path provided for conveying said continuous paper ribbon, and wherein said first ink jet printing unit is arranged along said common stretch.

7. Printing device for receipts, each receipt having a first area bearing constant data that is the same from one receipt to another, and a second area bearing variable data that varies from one receipt to another, said device comprising:

a roll containing a continuous paper ribbon, a first printing unit, ink jet, dot-matrix type, a second printing unit thermal, dot-matrix type, said first and said second printing units being arranged along a print path, a feeding mechanism that feeds said paper ribbon along said print path to permit printing of said paper ribbon by said first and said second printing units, a cutter that cuts said continuous paper ribbon after the printing, so as to form the receipts, and a control unit connected to said first ink jet printing unit and said second thermal printing unit, the control unit adapted to cause, for each receipt, said first ink jet printing unit to print on said paper ribbon said constant data, and to cause said second thermal printing unit to print on said paper ribbon said variable data, wherein said control unit is adapted to manage the operation of said printing device so that said first ink jet printing unit prints said constant data for each of said receipts, automatically and independently of said variable data, during a first preliminary printing step, and said second thermal printing unit prints, in response to a print command, said variable data received from said control unit and relative to each of said receipts, during a second printing step following said first printing step, wherein said second thermal printhead is adapted to print, during said second step subsequent to said first step, a given length of said ribbon at a printing speed that is greater than that of said first ink jet printhead, during said first printing step, wherein said first ink jet printing unit is arranged downstream of said second thermal printing unit along said print path according to the direction of feeding of said paper ribbon.

8. Printing device for receipts, each receipt having a first area bearing constant data that is the same from one receipt to another, and a second area bearing variable data that varies from one receipt to another, said device comprising:

a roll containing a continuous paper ribbon, a first printing unit, ink jet, dot-matrix type, a second printing unit thermal, dot-matrix type, said first and said second printing units being arranged along a print path, a feeding mechanism that feeds said paper ribbon along said print path to permit printing of said paper ribbon by said first and said second printing units, a cutter that cuts said continuous paper ribbon after the printing, so as to form the receipts, and a control unit connected to said first ink jet printing unit and said second thermal printing unit, the control unit adapted to cause, for each receipt, said first ink jet printing unit to print on said paper ribbon said constant data, and to cause said second thermal printing unit to print on said paper ribbon said variable data, wherein said control unit is adapted to manage the operation of said printing device so that said first ink jet printing unit prints said constant data for each of said receipts, automatically and independently of said variable data, during a first preliminary printing step, and said second thermal printing unit prints, in response to a print command, said variable data received from said control unit and relative to each of said receipts, during a second printing step following said first printing step, wherein said first ink jet printing unit is arranged downstream of said second thermal printing unit along said print path according to the direction of feeding of said paper ribbon.

9. Printing device for receipts, each receipt having a first area bearing constant data that is the same from one receipt to another, and a second area bearing variable data that varies from one receipt to another, said device comprising:

a roll containing a continuous paper ribbon, a first printing unit, ink jet, dot-matrix type, a second printing unit thermal, dot-matrix type, said first and said second printing units being arranged along a print path, a feeding mechanism that feeds said paper ribbon along said print path to permit printing of said paper ribbon by said first and said second printing units, a cutter that cuts said continuous paper ribbon after the printing, so as to form the receipts, and a control unit connected to said first ink jet printing unit and said second thermal printing unit, the control unit adapted to cause, for each receipt, said first ink jet printing unit to print on said paper ribbon said constant data, and to cause said second thermal printing unit to print on said paper ribbon said variable data, wherein said second thermal printing unit is of the in-line type and comprises a printhead arranged in a fixed position transversally with respect to said paper ribbon and also having a width substantially corresponding to that of a single line to be printed on said paper ribbon, wherein said first ink jet printing unit is arranged downstream of said second thermal printing unit along said print path according to the direction of feeding of said paper ribbon.

10. Printing device for receipts, each receipt having a first area bearing constant data that is the same from one receipt to another, and a second area bearing variable data that varies from one receipt to another, said device comprising:

a roll containing a continuous paper ribbon, a first printing unit, ink jet, dot-matrix type, a second printing unit thermal, dot-matrix type, said first and said second printing units being arranged along a print path, a feeding mechanism that feeds said paper ribbon along said print path to permit printing of said paper ribbon by said first and said second printing units, a cutter that cuts said continuous paper ribbon after the printing, so as to form the receipts, and a control unit connected to said first ink jet printing unit and said second thermal printing unit, the control unit adapted to cause, for each receipt, said first ink jet printing unit to print on said paper ribbon said constant data, and to cause said second thermal printing unit to print on said paper ribbon said variable data, wherein said first ink jet printing unit is arranged downstream of said second thermal printing unit along said print path according to the direction of feeding of said paper ribbon.

11. Printing device for receipts, each receipt having a first area bearing constant data that is the same from one receipt to another, and a second area bearing variable data that varies from one receipt to another, said device comprising:

a roll containing a continuous paper ribbon, a first printing unit, ink jet, dot-matrix type, a second printing unit thermal, dot-matrix type, said first and said second printing units being arranged along a print path, a feeding mechanism that feeds said paper ribbon along said print path to permit printing of said paper ribbon by said first and said second printing units, a cutter that cuts said continuous paper ribbon after the printing, so as to form the receipts, and a control unit connected to said first ink jet printing unit and said second thermal printing unit, the control unit adapted to cause, for each receipt, said first ink jet printing unit to print on said paper ribbon said constant data, and to cause said second thermal printing unit to print on said paper ribbon said variable data, a further print path for single documents consisting of single separate sheets, wherein said further print path extends between an entrance zone that receives said single documents, and an exit zone that delivers said single documents to the outside after printing, wherein said further print path shares a common outlet stretch with the print path provided for conveying said continuous paper ribbon, and wherein said first ink jet printing unit is arranged along said common stretch, wherein said first ink jet printing unit is arranged downstream of said second thermal printing unit along said print path according to the direction of feeding of said paper ribbon.

* * * * *